US008973390B2

(12) United States Patent
Shirota et al.

(10) Patent No.: US 8,973,390 B2
(45) Date of Patent: Mar. 10, 2015

(54) INDOOR UNIT OF AIR-CONDITIONING APPARATUS AND AIR-CONDITIONING APPARATUS

(75) Inventors: Mitsuhiro Shirota, Tokyo (JP); Tomoya Fukui, Tokyo (JP); Shoji Yamada, Tokyo (JP); Kenichi Sakoda, Tokyo (JP); Kunihiko Kaga, Tokyo (JP); Takeshi Mori, Tokyo (JP); Satoshi Michihata, Tokyo (JP); Akira Takamori, Tokyo (JP); Shinichi Suzuki, Tokyo (JP); Yoshinori Tanikawa, Tokyo (JP); Takashi Matsumoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 254 days.

(21) Appl. No.: 13/197,028

(22) Filed: Aug. 3, 2011

(65) Prior Publication Data

US 2012/0031134 A1 Feb. 9, 2012

(30) Foreign Application Priority Data

Aug. 4, 2010 (JP) ..... 2010-175222

(51) Int. Cl.
*F25D 21/14* (2006.01)
*F24F 1/00* (2011.01)
*F24F 13/22* (2006.01)

(52) U.S. Cl.
CPC ..... *F24F 1/0029* (2013.01); *F24F 1/0033* (2013.01); *F24F 1/0059* (2013.01); *F24F 13/222* (2013.01); *F24F 2013/227* (2013.01)
USPC ..... 62/288; 62/290

(58) Field of Classification Search
CPC ..... F25D 21/14; F25D 2321/144; F25D 2321/145; F25D 2321/146; F24F 2013/227; F24F 13/222
USPC ..... 62/263, 286, 288, 289, 290
See application file for complete search history.

(56) References Cited

U.S. PATENT DOCUMENTS 3,352,126 A * 11/1967 Beshekas ..... 62/286
3,628,590 A * 12/1971 Knebusch ..... 62/330

(Continued)

FOREIGN PATENT DOCUMENTS

JP 06-257778 A 9/1994
JP 2002-213766 A 7/2002

(Continued)

OTHER PUBLICATIONS

Office Action (Notice of Reasons for Rejection) dated Sep. 25, 2012, issued in corresponding Japanese Patent Application No. 2010-175222, and an English Translation thereof. (5 pages).

(Continued)

*Primary Examiner* — Mohammad M Ali
*Assistant Examiner* — Christopher R Zerphey
(74) *Attorney, Agent, or Firm* — Buchanan Ingersoll & Rooney PC

(57) ABSTRACT

An indoor unit includes a heat exchanger provided on the downstream side of a fan and formed with a plurality of lower end portions in a vertical cross section from the front side to the back side of a casing, a plurality of drain pans provided below the lower end portions of the heat exchanger and configured to collect drain water occurring on the heat exchanger, and a drain channel provided between the drain pans and configured to be a flow channel of the drain, and a connecting port to which a drain hose configured to drain the drain water collected by the drain pans to the outside of the casing, and one of the drain pans is arranged to a level equal to or higher than the level of the other drain pan, and the drain channel is provided on the drain pan arranged on the back side of the casing.

6 Claims, 12 Drawing Sheets

(56) References Cited

U.S. PATENT DOCUMENTS

| | | | | |
|---|---|---|---|---|
| 4,100,764 | A * | 7/1978 | Murano | 62/289 |
| 6,240,740 | B1 * | 6/2001 | Endo et al. | 62/285 |
| 2005/0109055 | A1 * | 5/2005 | Goetzinger et al. | 62/291 |
| 2005/0132737 | A1 * | 6/2005 | Jeon | 62/298 |
| 2006/0191289 | A1 * | 8/2006 | Bush et al. | 62/515 |
| 2007/0169501 | A1 * | 7/2007 | Rios | 62/286 |
| 2008/0047289 | A1 * | 2/2008 | Patrick et al. | 62/285 |
| 2009/0249812 | A1 * | 10/2009 | Timbs et al. | 62/285 |

FOREIGN PATENT DOCUMENTS

| | | | |
|---|---|---|---|
| JP | 2003-254552 | A | 9/2003 |
| JP | 2004-245570 | A | 9/2004 |
| JP | 2005-003244 | A | 1/2005 |
| WO | WO 2010/089920 | A1 | 8/2010 |

OTHER PUBLICATIONS

Office Action (Decision of Refusal) dated Feb. 26, 2013, issued in corresponding Japanese Patent Application No. 2010-175222, and an English Translation thereof. (5 pages).

Office Action (Decision of Refusal) dated Jul. 3, 2013, issued in corresponding Chinese Patent Application No. 200980123838.7, and an English translation thereof.

US 3,691,789, 09/1972, Anderson et al. (withdrawn)*

* cited by examiner

INDOOR UNIT OF AIR-CONDITIONING APPARATUS AND AIR-CONDITIONING APPARATUS

BACKGROUND OF THE INVENTION

1. Field of the Invention

The present invention relates to an indoor unit having a fan and a heat exchanger housed in a casing and an air-conditioning apparatus having the indoor unit.

2. Description of the Related Art

Conventionally, an indoor unit provided with a drain pan configured to collect drain water occurring on a heat exchanger is proposed. An example of the indoor unit described above is one where "the indoor unit includes a heat exchanger 4, a fan rotor 203, a front drain pan 212*h*, a rear drain pan 212*g*, a fan motor, and a bottom frame module 212. The heat exchanger 4 includes a front side heat exchanging portion 4*a* provided on the front side and a back side heat exchanging portion 4*b* provided on the back side. The front drain pan 212*h* is positioned below a lower end of the front side heat exchanging portion 4*a*, and the rear drain pan 212*g* is positioned below a lower end of the back side heat exchanging portion 4*b*. A motor covering portion of the bottom frame module 212 covers over the fan motor, and is formed with a communication channel 212*f* which allows communication between the front drain pan 212*h* and the rear drain pan 212*g*." (see Japanese Unexamined Patent Application Publication No. 2003-254552, Abstract, FIG. 9) is proposed.

In the conventional indoor unit, a heat exchanger is arranged so as to cover the front, top, and rear top of the fan (cross-flow fan, or the like). A front side drain pan (for example, the front drain pan 212*h* disclosed in Japanese Unexamined Patent Application Publication No. 2003-254552, Abstract, FIG. 9) is used also as a member which forms an upper surface portion of a nozzle provided on the upstream side of the blow-out port and a front edge portion of the suction port of the fan. A back side drain pan (for example, the rear drain pan 212*g* disclosed in Japanese Unexamined Patent Application Publication No. 2003-254552, Abstract, FIG. 9) is used also as a member which forms a rear edge portion of the suction port of the fan. Therefore, in the conventional indoor unit, the back side drain pan is required to be arranged on a level higher than the front side drain pan. In other words, in the conventional indoor unit, when draining the drain water collected by the front side drain pan and the back side drain pan to the outside of the casing using a drain hose connected to one of the drain pans, one has to connect the drain hose to the front side drain pan. Therefore, one has to detach and attach the front side drain pan having the drain hose connected thereto when performing maintenance (cleaning or the like of the fan or the heat exchanger) of the indoor unit after opening the front side portion or the like of the casing, which disadvantageously lead to poor maintainability.

SUMMARY OF THE INVENTION

In order to solve the above-described problem, it is an object of the invention to provide an indoor unit of an air-conditioning apparatus, in which maintainability can be improved, and an air-conditioning apparatus having such an indoor unit.

An indoor unit of an air-conditioning apparatus according to the invention includes a casing having a suction port formed on an upper portion and a blow-out port formed on a lower side of a front surface portion; an axial-flow or mixed-flow fan provided on the downstream side of the suction port in the casing; a heat exchanger provided in the casing at a position on the downstream side of the fan and on the upstream side of the blow-out port, and formed with a plurality of lower end portions in a vertical cross section from the front side to the back side of the casing; a plurality of drain pans provided under the lower end portions of the heat exchanger respectively and configured to collect drain water occurring on the heat exchanger; a drain channel provided between the adjacent drain pans to form a drain flow channel; and a connecting port allowing connection of a drain hose, provided at any one of the drain pans, draining the drain water collected by the plurality of drain pans to the outside of the casing, in which the adjacent drain pans among the plurality of drain pans are arranged so that the drain pan provided on the front side of the casing is arranged in a level equal to or higher than the drain pan provided on the back side of the casing, and the connecting port is provided on the drain pan arranged on the backmost side of the casing.

The air-conditioning apparatus according to the invention includes the indoor unit described above.

In the invention, the fan is arranged on the upstream side of the heat exchanger. Therefore, when viewing the heights of the adjacent lower end portions of the heat exchanger in a vertical cross section from the front side to the back side of the casing, the lower end portion positioned on the front side of the casing can be set to a level equal to or higher than the lower end portion positioned on the back side of the casing. In other words, when viewing the heights of the adjacent drain pans in the vertical cross section from the front side to the back side, the drain pan provided on the front side of the casing can be set to a level equal to or higher than the drain pan provided on the back side of the casing. Accordingly, drain water collected by the plurality of drain pans can be collected to the drain pan arranged on the backmost side of the casing. Therefore, by providing the connecting port of the drain hose on the drain pan arranged on the backmost side of the casing, the drain water collected in the plurality of drain pans can be drained to the outside of the casing. Therefore, it is not necessary to detach and attach the drain pan having the drain hose connected thereto when performing maintenance (cleaning of the heat exchangers and the like) of the indoor unit after opening the front side portion or the like of the casing, which advantageously improves workability during maintenance and the like.

DESCRIPTION OF THE PREFERRED EMBODIMENTS

Figure 1:
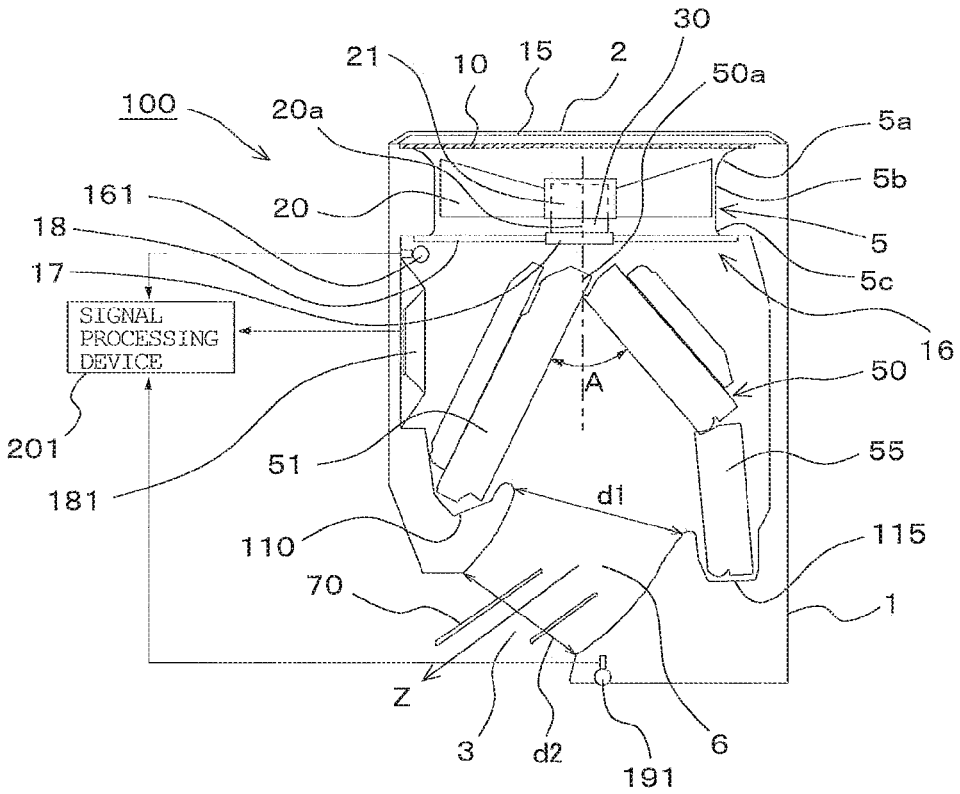
FIG. 1 is a vertical cross-sectional view illustrating an indoor unit of an air-conditioning apparatus according to Embodiment 1 of the invention.

Hereinafter, detailed embodiments of an air-conditioning apparatus according to the invention (more specifically, an indoor unit of the air-conditioning apparatus) will be described. In the following embodiments, the invention will be described with a wall indoor unit taken as an example. In the drawings showing respective embodiments, part of the shapes or the sizes of each units (or the components of each units) may be different.

Embodiment 1

<Basic Configuration>

Figure 2:
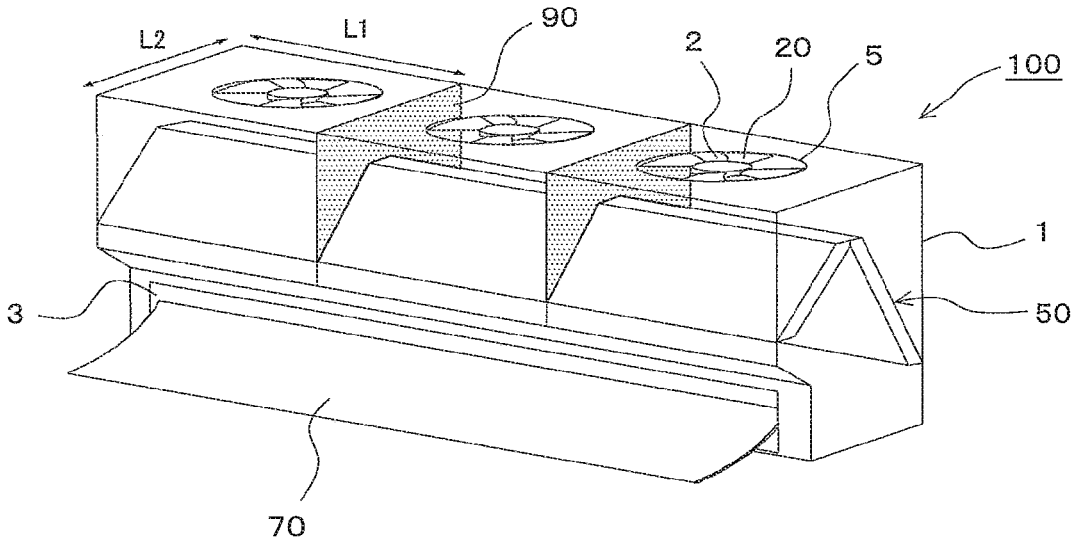
FIG. 2 is a perspective view illustrating the indoor unit of the air-conditioning apparatus according to Embodiment 1 of the invention.

FIG. 1 is a vertical cross-sectional view illustrating an indoor unit (referred to as "indoor unit 100") of an air-conditioning apparatus according to Embodiment 1 of the invention. FIG. 2 is a perspective view illustrating the indoor unit shown in FIG. 1. In the description of Embodiment 1 and other embodiments described later, the left side in FIG. 1 is defined as the front side of the indoor unit 100. Referring now to FIG. 1 and FIG. 2, a configuration of the indoor unit 100 will be described.

(General Configuration)

The indoor unit 100 supplies air-conditioned air to an area to be air-conditioned such as an indoor space by utilizing a refrigerating cycle circulating a refrigerant. The indoor unit 100 mainly includes a casing 1 formed with suction ports 2 for taking in indoor air and a blow-out port 3 for supplying air-conditioned air to the area to be air-conditioned, fans 20 housed in the casing 1 and configured to take in the indoor air from the suction ports 2 and blow out the air-conditioned air from the blow-out port 3, and heat exchangers 50 disposed in air paths from the fans 20 to the blow-out port 3 and configured to generate the air-conditioned air by heat exchange between the refrigerant and the indoor air. In these components, each of the air paths (an arrow Z in FIG. 1) communicates with the interior of the casing 1. The suction ports 2 are formed so as to open at an upper portion of the casing 1. The blow-out port 3 is formed so as to open at a lower portion of the casing 1 (more specifically, on the lower side of a front surface portion of the casing 1). The fans 20 are each disposed on the downstream side of the suction ports 2 and the upstream side of the heat exchangers 50, and, for example, axial-flow fans or mixed-flow fans are employed.

Since the fans 20 are provided on the upstream side of the heat exchangers 50 in the indoor unit 100 as configured above, generation of a swirl flow of air blown out from the blow-out port 3 and occurrence of variation in wind velocity distribution can be restrained in comparison with the indoor unit of the conventional air-conditioning apparatus having the fan 20 at the blow-out port 3. Therefore, blowing of comfortable air to the area to be air-conditioned is achieved. Since no complex structure such as a fan is provided at the blow-out port 3, measures against dew condensation formed at a boundary between warm air and cool air at the time of a cooling operation can easily be implemented. In addition, since a fan motor 30 is not exposed to air-conditioned air, namely, cool air or warm air, a long operational life can be provided.

(Fan)

In general, the indoor unit of the air-conditioning apparatus has limitations in terms of installation space, so the fan cannot be increased in size in many cases. Therefore, in order to obtain a desired air volume, a plurality of fans of moderate sizes are arranged in parallel, In the indoor unit 100 according to Embodiment 1, three fans 20 are arranged in parallel along the longitudinal direction of the casing 1 (that is, along the longitudinal direction of the blow-out port 3) as shown in FIG. 2. In order to obtain a desired heat-exchange capacity with the indoor unit of the air-conditioning apparatus having typical dimensions, three to four fans 20 are preferably provided. In the indoor unit according to Embodiment 1, substantially equivalent air volumes can be obtained from all of the fans 20 by configuring all of the fans 20 to have an identical shape and so as to operate all with the same rotation speed.

In this configuration, by combining the number, the shape, and the size of the fans 20 according to the required air volume and the air-flow resistance in the interior of the indoor unit 100, an optimal fan design for the indoor units 100 having various specifications is achieved.

(Bell Mouth)

In the indoor unit 100 according to Embodiment 1, a duct-like bell mouth 5 is arranged around each of the fans 20. The bell mouth 5 is intended to guide intake air into and exhaust air out of the fans smoothly. As shown in FIG. 2, for example, the bell mouth 5 according to Embodiment 1 has a substantially circular shape in plan view. In the vertical cross section, the bell mouth 5 according to Embodiment 1 has the following shape. An end portion of an upper portion 5*a* has a substantially circular arc shape extending outward and upward. A center portion 5*b* is a straight portion of the bell mouth 5, having a constant diameter. An end portion of a lower portion 5*c* has a substantially circular arc shape extending outward and downward. An end portion (a circular arc portion on the suction side) of the upper portion 5*a* of the bell mouth 5 forms the suction port 2.

The bell mouth 5 may be formed integrally with, for example, the casing 1 in order to reduce the number of components and improve the strength. It is also possible, for example, to improve maintainability by modularizing the bell mouth 5, the fan 20, and the fan motor 30 so as to be detachably attachable to the casing 1.

In Embodiment 1, the end portion (the circular arc portion on the suction side) of the upper portion 5*a* of the bell mouth 5 is formed so as to have a uniform shape in terms of the circumferential direction of an opening surface of the bell mouth 5. In other words, the bell mouth 5 does not have structures such as a notch or a rib in the direction of rotation about an axis of rotation 20*a* of the fan 20, and has a uniform shape in terms of axial symmetry.

With the configuration of the bell mouth 5 as described above, the end portion (the circular arc portion on the suction side) of the upper portion 5*a* of the bell mouth 5 has a uniform shape with respect to the rotation of the fan 20, and hence a uniform flow of the suction flow of the fan 20 is also realized. Therefore, the noise generated by a drift of the suction flow of the fan 20 can be decreased.

(Partitioning Panel)

As shown in FIG. 2, the indoor unit 100 according to Embodiment 1 is provided with partitioning panels 90 between the adjacent fans 20. These partitioning panels 90 are installed between the heat exchangers 50 and the fans 20. In other words, the air paths between the heat exchangers 50 and the fans 20 are divided into a plurality of air paths (three in Embodiment 1). The partitioning panels 90 are arranged between the heat exchangers 50 and the fans 20, so each end portion that is in contact with the heat exchanger 50 has a shape conforming to the shape of the heat exchanger 50. More specifically, as shown in FIG. 1, the heat exchanger 50 is arranged so as to form a substantially A-shape in a vertical cross section from the front side to the back side of the indoor unit 100 (that is, the vertical cross section when viewing the indoor unit 100 from the right side, referred to as "right vertical cross-section", hereinafter). Therefore, an end portion of each of the partitioning panels 90 on the side of the heat exchanger 50 also has a substantially A-shape.

The position of an end portion of each of the partitioning panels 90 on the side of the fan 20 may be determined as follows, for example. When the adjacent fans 20 are positioned sufficiently away from each other to avoid influencing each other on the suction side, the end portion of each of the partitioning panels 90 on the side of the fan 20 may need only be extend to an exit surface of the fan 20. However, in a case where the adjacent fans 20 are as near to each other to influence each other on the suction side and, in addition, in a case where the shape of the end portion (the circular arc portion on the suction side) of the upper portion 5*a* of the bell mouth 5 can be formed sufficiently large, the end portion of each of the partitioning panels 90 on the side of the fan 20 may extend up to the upstream side of the fan 20 (the suction side) so that the adjacent air paths do not influence each other (the adjacent fans 20 do not influence each other on the suction side).

The partitioning panels 90 may be formed of various materials. For example, the partitioning panels 90 may be formed of a metal such as steel or aluminum. Also, for example, the partitioning panels 90 may be formed of a resin. When the partitioning panels 90 are formed of a material with a low melting point such as a resin, however, since the heat exchangers 50 are heated to high temperatures at the time of a heating operation, formation of slight spaces between the partitioning panels 90 and the heat exchangers 50 is recommended. When the partitioning panels 90 are formed of a material with a high melting point such as aluminum or steel, the partitioning panels 90 may be arranged so as to be in contact with the respective heat exchangers 50 or the partitioning panels 90 may be inserted between the fins of the heat exchangers 50.

As described above, the air path between the heat exchangers 50 and the fans 20 is divided into a plurality of air paths (three in Embodiment 1). It is also possible to reduce the noise generated in the ducts by providing sound-absorbing materials in these air paths, that is, on the partitioning panels 90 or in the casing 1.

The divided air paths are each formed into a substantially square shape of L1×L2. In other words, the widths of the divided air paths are L1 and L2. Therefore, the air volume generated by the fan 20 installed in the interior of the substantially square shape of L1×L2, for example, reliably passes through the heat exchanger 50 surrounded by an area defined by L1 and L2 on the downstream side of the fan 20.

By dividing the air path in the casing 1 into the plurality of air paths as described above, even when the flow field which is generated by the fan 20 on the downstream side has a swirling component, air blown out from each of the fans 20 is prevented from moving freely in the longitudinal direction of the indoor unit 100 (the direction orthogonal to the plane of the paper of FIG. 1). Therefore, the air blown out from the fan 20 can be made to pass through the heat exchanger 50 in the area defined by L1 and L2 on the downstream side of the fan 20. Consequently, variations in air volume distribution of the air flowing into all the heat exchangers 50 in the longitudinal direction of the indoor unit 100 (the direction orthogonal to the plane of the paper of FIG. 1) is restrained, so that a high heat exchanging capacity can be provided. Furthermore, by partitioning the interior of the casing 1 by using the partitioning panels 90, the mutual interference of the swirl flows generated by the adjacent fans 20 can be prevented between the fans 20 adjacent to each other. Therefore, an energy loss of fluid due to the mutual interference of the swirl flows can be prevented, and hence reduction of a pressure loss in the indoor unit 100 is possible in addition to the improvement in the wind velocity distribution. Each of the partitioning panels 90 does not necessarily have to be formed of a single plate, and may be made up of a plurality of plates. For example, the partitioning panel 90 may be divided into two parts on the side of a front side heat exchanger 51 and on the side of a back side heat exchanger 55. Needless to say, it is preferable that no gap be formed at a joint portion between the respective plates which constitute the partitioning panel 90. By dividing the partitioning panel 90 into a plurality of plates, assemblability of the partitioning panels 90 is improved.

(Fan Motor)

The fan 20 is driven and rotated by the fan motor 30. The fan motor 30 to be used may be either of an inner-rotor type or an outer-rotor type. In the case of the fan motor 30 of the outer-rotor type, a motor having a structure in which a rotor is integrated with a boss 21 of the fan 20 (the rotor is held by the boss 21) is also employed. By setting the dimensions of the fan motor 30 to be smaller than the dimensions of the boss 21 of the fan 20, loss of airflow generated by the fan 20 can be prevented. In addition, by disposing the motor in the interior of the boss 21, an axial dimension can also be reduced. With the easily detachable and attachable structure of the fan motor 30 and the fan 20, cleanability is also improved.

By using a Brushless DC motor which is relatively high in cost as the fan motor 30, improvement in efficiency, elongation of service life, and improvement in controllability are achieved. Needless to say, however, a primary function of an air-conditioning apparatus is achieved even when motors of other types are employed.

A circuit for driving the fan motor 30 may be integrated with the fan motor 30, or may be provided externally for dust-proofing measures and fire prevention measures.

The fan motor 30 is attached to the casing 1 using a motor stay 16. In addition, by configuring the fan motor 30 to be of a box-type fan motor (in which the fan 20, a housing, and the fan motor 30 are integrally modularized) used for cooling a CPU and configuring the fan motor 30 so as to be detachably attached to the motor stay 16, maintainability can be improved, and accuracy of tip clearance of the fan 20 can also be improved.

A drive circuit of the fan motor 30 may be provided either in the interior of or on the exterior of the fan motor 30.

(Motor Stay)

The motor stay 16 is provided with a fixing member 17 and supporting members 18. The fixing member 17 is a member to which the fan motor 30 is attached. The supporting members 18 are members configured to fix the fixing member 17 to the casing 1. The supporting members 18 are, for example, rod-shaped members, and extend, for example, radially from an outer peripheral portion of the fixing member 17. As shown in FIG. 1, the supporting members 18 according to Embodiment 1 are extend approximately horizontally.

(Heat Exchanger)

The heat exchangers 50 of the indoor unit 100 according to Embodiment 1 are arranged on the downstream side [illegible] s of the fans 20. Fin and tube heat exchangers are preferably used as the heat exchangers 50. The heat exchangers 50 are each divided by a line of symmetry 50*a* in the right vertical cross section as shown in FIG. 1. The line of symmetry 50*a* divides the area substantially in the center in the horizontal direction of which the heat exchanger 50 is installed in this cross section. In other words, the front side heat exchanger 51 is arranged on the front side (the left side in the plane of the paper in FIG. 1) with respect to the line of symmetry 50*a* and the back side heat exchanger 55 is arranged on the back side (the right side in the plane of the paper in FIG. 1) with respect to the line of symmetry 50*a*, respectively. The front side heat exchanger 51 and the back side heat exchanger 55 are arranged in the casing 1 so that the distance between the front side heat exchanger 51 and the back side heat exchanger 55 increases in the direction of an air current, that is, so that the cross-sectional shape of the heat exchanger 50 forms a substantially inverted V-shape in the right vertical cross section. In other words, the front side heat exchanger 51 and the back side heat exchanger 55 are arranged so as to be inclined with respect to the direction of the air current supplied from the fan 20.

In addition, the heat exchanger 50 is characterized in that the air path area of the back side heat exchanger 55 is larger than the air path area of the front side heat exchanger 51. In other words, the heat exchanger 50 is arranged so that the air volume of the back side heat exchanger 55 is larger than the air volume of the front side heat exchanger 51. In Embodiment 1, the length of the back side heat exchanger 55 in the longitudinal direction is larger than the length of the front side heat exchanger 51 in the longitudinal direction in the right vertical cross section. Accordingly, the air path area of the back side heat exchanger 55 is larger than the air path area of the front side heat exchanger 51. The rest of the configuration (such as the lengths in the depth direction in FIG. 1) of the front side heat exchanger 51 and that of the back side heat exchanger 55 are the same. In other words, the heat conduction area of the back side heat exchanger 55 is larger than the heat conduction area of the front side heat exchanger 51. Also, the axis of rotation 20*a* of the fan 20 is arranged above the line of symmetry 50*a*.

With the configuration of the heat exchanger 50 as described above, the generation of the swirl flow of the air blown out from the blow-out port 3 and the occurrence of a variation in wind velocity distribution can be restrained in comparison with the indoor unit of the conventional air-conditioning apparatus having the fan at the blow-out port. The air volume of the back side heat exchanger 55 is larger than the air volume of the front side heat exchanger 51. Because of this difference in air volume, when air currents having passed through the front side heat exchanger 51 and the back side heat exchanger 55 merge, the merged air current is curved toward the front side (the side of the blow-out port 3). Therefore, necessity to curve the airflow steeply in the vicinity of the blow-out port 3 is eliminated, and hence the pressure loss in the vicinity of the blow-out port 3 can be reduced.

In the indoor unit 100 according to Embodiment 1, the air current flowing out from the back side heat exchanger 55 flows in the direction from the back side to the front side. Therefore, in the indoor unit 100 according to Embodiment 1, the air current after having passed the heat exchanger 50 can be curved more easily than in the case where the heat exchanger 50 is arranged in a substantially V-shape in the right vertical cross section.

The indoor unit 100 includes the plurality of fans 20, which often results in an increase in weight. When the weight of the indoor unit 100 increases, a wall surface strong enough for installing the indoor unit 100 is required, which leads to a restriction of installation. Therefore, reduction of weight of the heat exchanger 50 is preferred. In addition, in the indoor unit 100, since the fans 20 are arranged on the upstream sides of the heat exchangers 50, the height of the indoor unit 100 is increased, which often leads to a restriction of installation. Therefore, it is preferred that the heat exchanger be configured light in weight and compact in size.

Accordingly, in Embodiment 1, the heat exchanger 50 is made up of a fin formed of aluminum and a circular heat-transfer tube formed of aluminum. At this time, when forming the heat-transfer tube to be thin (on the order of 3 mm to 6 mm in diameter), the heat exchanger 50 can further be decreased in size and weight. When a decrease in the weight of the heat exchanger 50 is not necessary, the heat-transfer tube may be formed of copper, as a matter of course.

The heat exchanger 50 is configured to exchange heat between the refrigerant flowing in the interiors of the heat-transfer tubes and the indoor air via the fins. Therefore, when the heat-transfer tubes which constitute the heat exchanger 50 is thinned down, a pressure loss of the refrigerant is larger than in the case of heat-transfer tubes having a large diameter in the same amount of circulation of the refrigerant. Therefore, the refrigerant to be used in the heat exchanger 50 according to Embodiment 1 is preferably R32. It is because the evaporation latent heat of R32 is higher than that of R410A at the same temperature, and hence the same capability can be achieved with a smaller amount of circulation of the refrigerant. In other words, by using R32, reduction of the amount of a refrigerant to be used is made possible, so that the pressure loss in the heat exchanger 50 can be reduced.

(Finger Guard and Filter)

The indoor unit 100 according to Embodiment 1, a finger guard 15 and a filter 10 are provided at the suction port 2. The finger guard 15 is installed for the purpose of preventing the rotating fan 20 from being touched. Therefore, the shape of the finger guard 15 is arbitrary as long as the fan 20 is prevented from being touched. For example, the shape of the finger guard 15 may be a lattice shape, or may be a circular shape made up of a number of rings having different sizes. Alternatively, the finger guard 15 may be formed either of materials such as resin or metallic materials. However, when strength is required, it is preferably formed of metal. The finger guard 15 is preferably formed of materials and shapes as strong and thin as possible in terms of reduction of air-flow resistance and retention of strength. The filter 10 is provided for the purpose of preventing dust from flowing into the interior of the indoor unit 100. The filter 10 is provided in the casing 1 so as be detachable and attachable. The indoor unit 100 according to Embodiment 1 includes an automatic cleaning mechanism which cleans the filter 10 automatically.

(Wind Direction Control Vane)

The indoor unit 100 according to Embodiment 1 includes a vertical wind direction control vane 70 (see FIG. 2) and a horizontal wind direction control vane 80, not shown, as a mechanism which controls the blowing direction of the air-flow at the blow-out port 3.

(Drain Pan)

Figure 3:
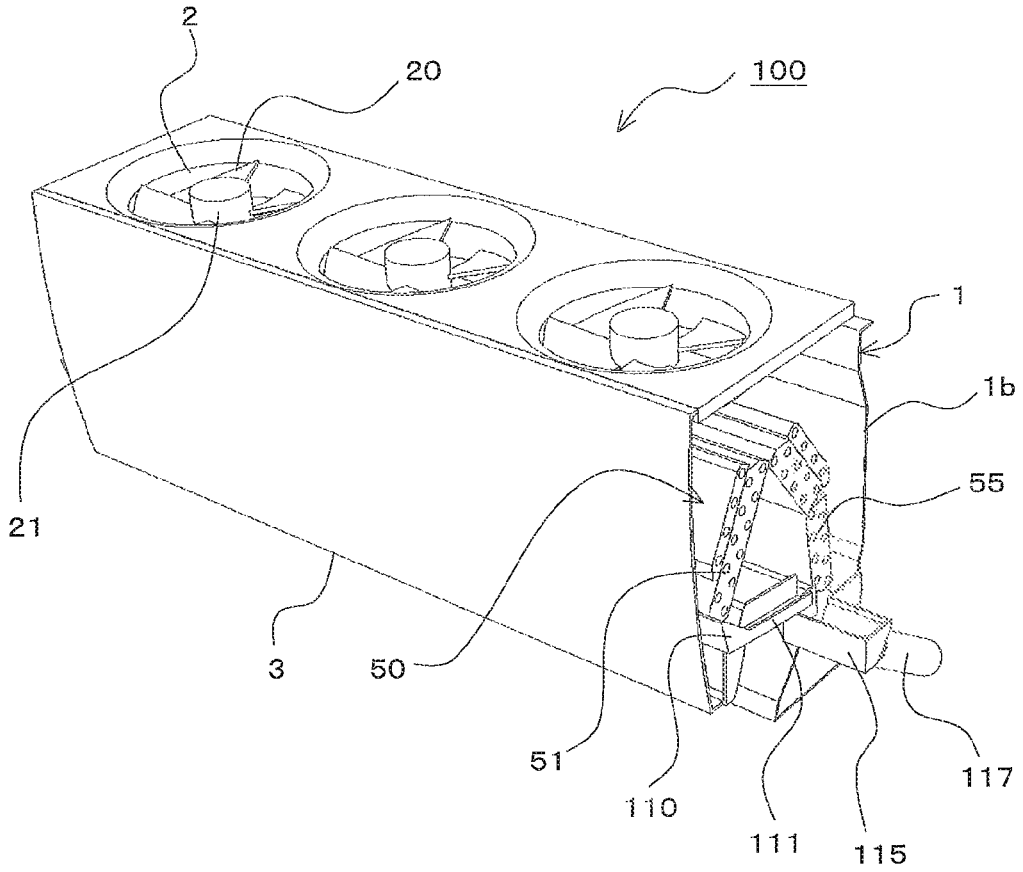
FIG. 3 is a perspective view of the indoor unit according to Embodiment 1 of the invention when viewed from the front right side.
Figure 4:
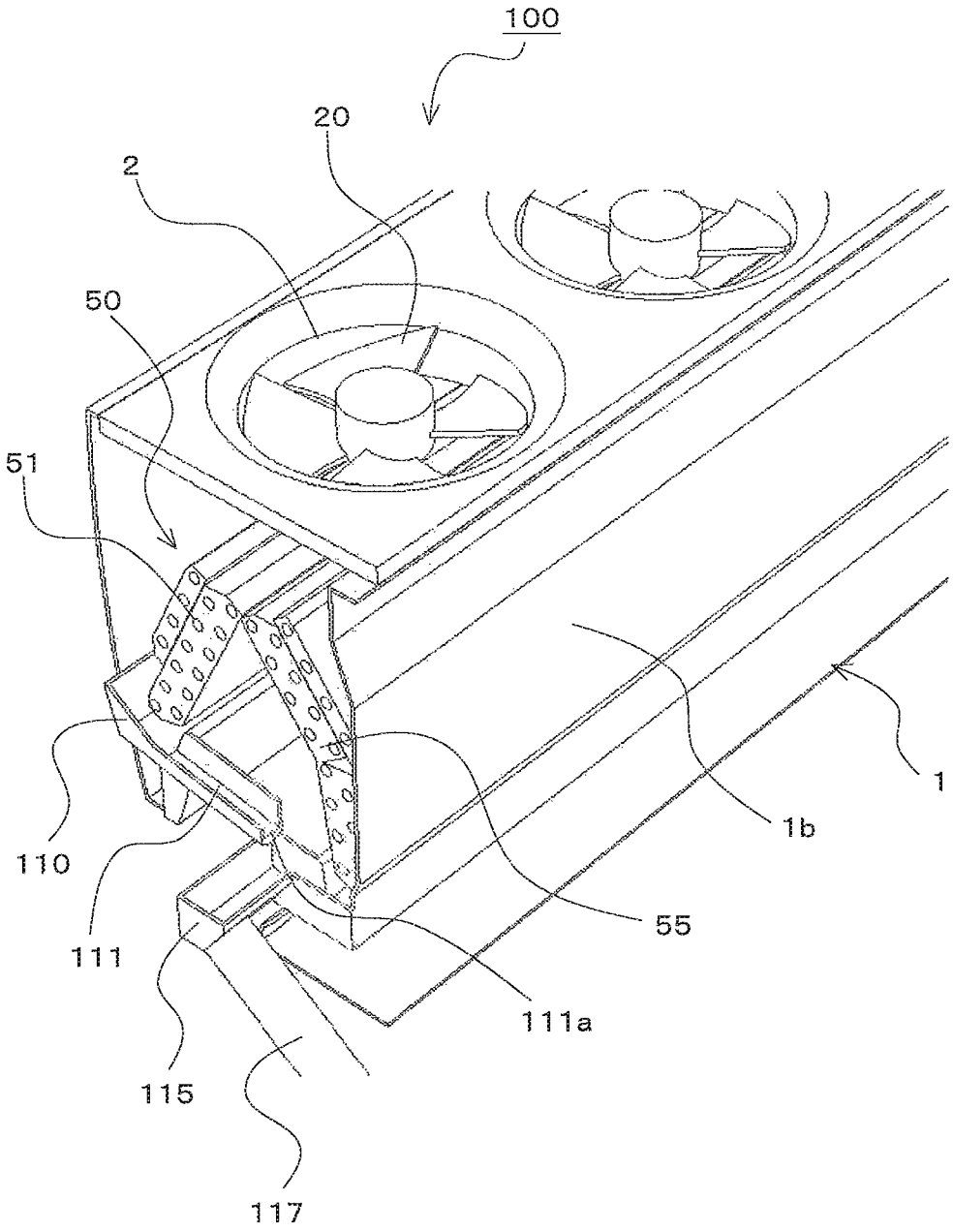
FIG. 4 is a perspective view of the indoor unit according to Embodiment 1 of the invention when viewed from the rear right side.
Figure 5:
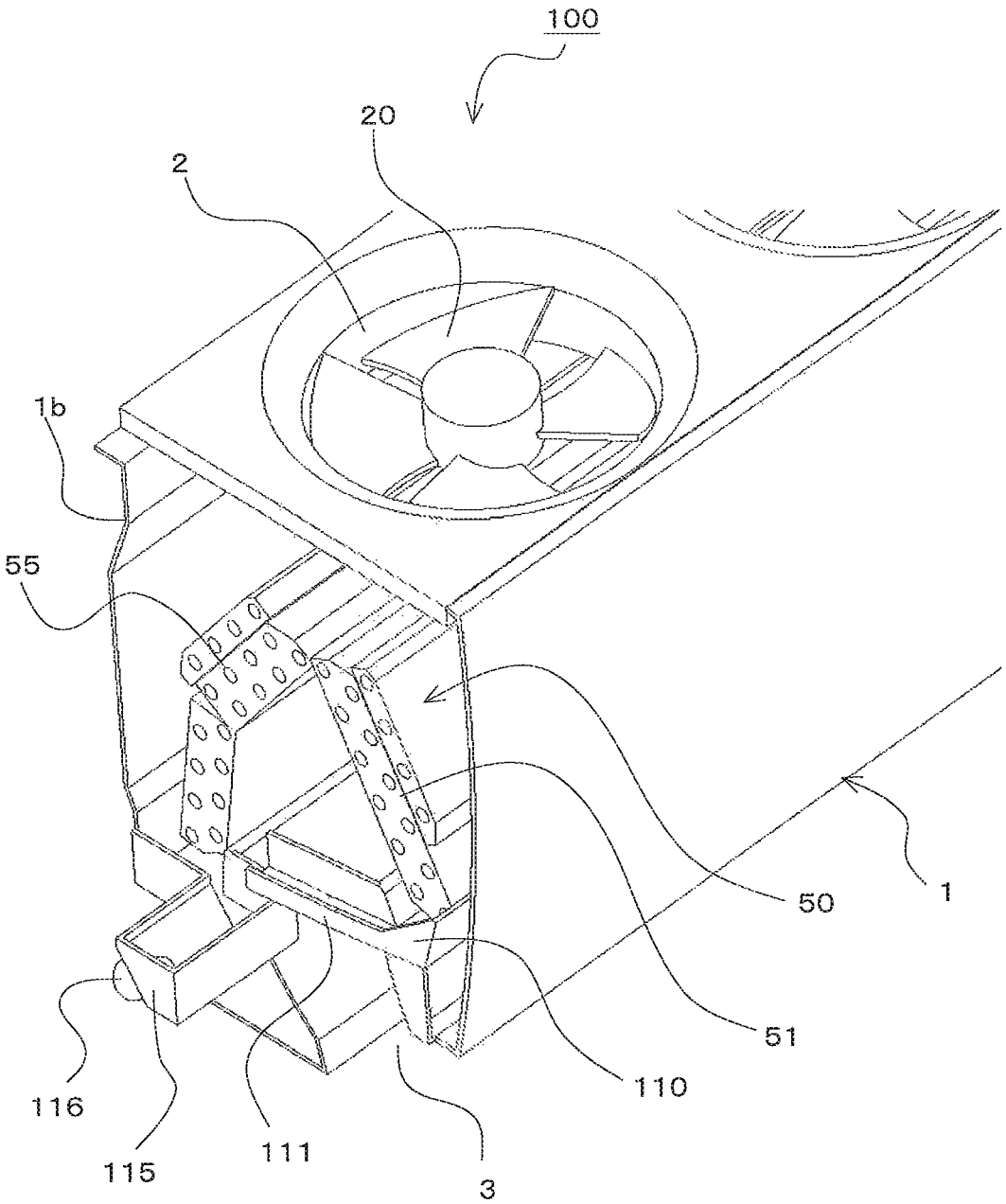
FIG. 5 is a perspective view of the indoor unit according to Embodiment 1 of the invention when viewed from the front left side.
Figure 6:
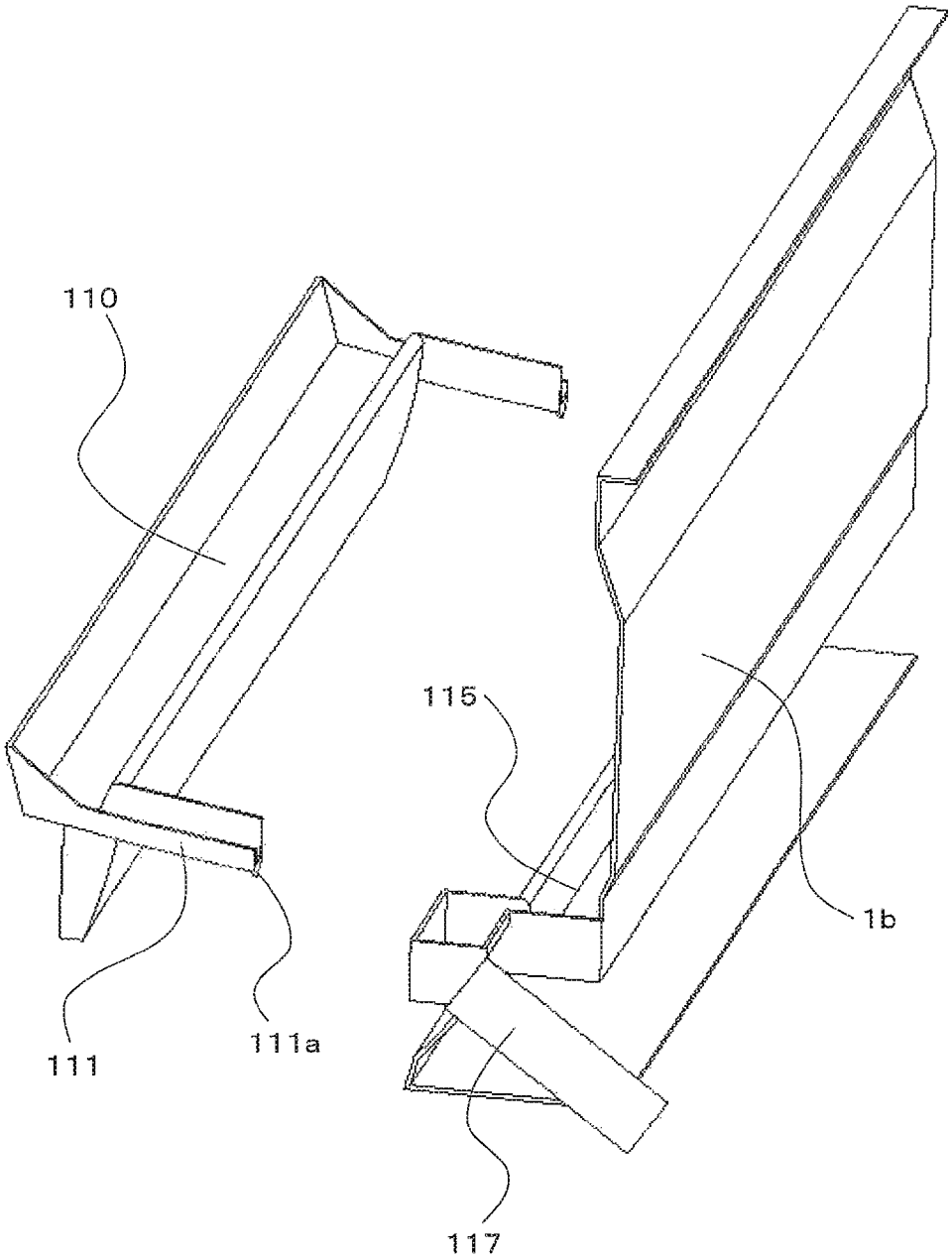
FIG. 6 is a perspective view illustrating a drain pan according to Embodiment 1 of the invention.

FIG. 3 is a perspective view of the indoor unit according to Embodiment 1 of the invention when viewed from the front right side. FIG. 4 is a perspective view of the same indoor unit when viewed from the back right side. FIG. 5 is a perspective view of the same indoor unit when viewed from the front left side. FIG. 6 is a perspective view illustrating a drain pan according to Embodiment 1 of the invention. In order to facilitate understanding of the shape of the drain pan, the right side of the indoor unit 100 is shown in cross section in FIG. 3 and FIG. 4, and the left side of the indoor unit 100 is shown in cross section in FIG. 5.

Provided below a lower end portion of the front side heat exchanger 51 (a front side end portion of the front side heat exchanger 51) is a front side drain pan 110. Provided below a lower end portion of the back side heat exchanger 55 (a back side end portion of the back side heat exchanger 55) is a back side drain pan 115. In Embodiment 1, the back side drain pan 115 and a back side portion 1*b* of the casing 1 are integrally formed. In the back side drain pan 115, connecting ports 116 to which a drain hose 117 is connected are provided on both a left side end portion and a right side end portion. It is not necessary to connect the drain hose 117 to both of the connecting ports 116, and the drain hose 117 may be connected to one of the connecting ports 116. For example, when drawing of the drain hose 117 to the right side of the indoor unit 100 is desired at the time of installation of the indoor unit 100, the drain hose 117 is connected to the connecting port 116 provided on the right side end portion of the back side drain pan 115, and the connecting port 116 provided on the left side end portion of the back side drain pan 115 may be closed with a rubber cap or the like.

The front side drain pan 110 is arranged at a position higher than the back side drain pan 115. Provided between the front side drain pan 110 and the back side drain pan 115 on both of the left side end portion and the right side end portion are drain channels 111 which correspond to drain flow channels. The drain channels 111 are each connected at an end portion on the front side thereof to the front side drain pan 110, and are provided so as to incline downward from the front side drain pan 110 toward the back side drain pan 115. Also, formed at end portions of the drain channels 111 on the back side are tongue portions 111*a*. The end portions of the drain channels 111 on the back side are arranged so as to extend over an upper surface of the back side drain pan 115.

When the indoor air is cooled by the heat exchangers 50 at the time of cooling operation, dew condensation forms on the heat exchangers 50. Then, dew on the front side heat exchanger 51 drops from the lower end portion of the front side heat exchanger 51, and is collected by the front side drain pan 110. Dew on the back side heat exchanger 55 drops from the lower end portion of the back side heat exchanger 55, and is collected by the back side drain pan 115.

Since the front side drain pan 110 is provided at a position higher than the back side drain pan 115 in Embodiment 1, the drain water collected by the front side drain pan 110 flows through the drain channel 111 toward the back side drain pan 115. Then, the drain water drops down from the tongue portion 111*a* of the drain channel 111 to the back side drain pan 115, and is collected by the back side drain pan 115. The drain water collected by the back side drain pan 115 passes through the drain hose 117, and is drained to the outside of the casing 1 (the indoor unit 100).

As in Embodiment 1, by providing the front side drain pan 110 at a position higher than the back side drain pan 115, the drain water collected by both of the drain pans can be gathered in the back side drain pan 115 (the drain pan arranged on the backmost side of the casing 1). Therefore, by providing the connecting port 116 of the drain hose 117 in the back side drain pan 115, the drain water collected in the front side drain pan 110 and the back side drain pan 115 can be drained to the outside of the casing 1. When performing maintenance (cleaning of the heat exchangers 50 and the like) of the indoor unit 100 by opening the front side portion or the like of the casing 1, there is, therefore, no need to detach and attach the drain pan having the drain hose 117 connected thereto, thus workability such as maintenance is improved.

Since the drain channels 111 are provided on both the left side end portion and the right side end portion, even when the indoor unit 100 is installed in an inclined state, the drain water collected in the front side drain pan 110 can be guided reliably to the back side drain pan 115. Since the connecting ports to which the drain hoses 117 are to be connected are provided on both the left side end portion and the right side end portion, the drawing direction of the hose can be selected according to the conditions of the indoor unit 100 in installation, so that workability when installing the indoor unit 100 is improved. Also, since the drain channels 111 are provided so as to extend over the back side drain pan 115 (that is, since a connecting mechanism is not necessary between the drain channel 111 and the back side drain pan 115), attachment and detachment of the front side drain pan 110 is facilitated, and hence maintainability is further improved.

It is also possible to connect the back side end of the drain channels 111 to the back side drain pan 115 and arrange the drain channels 111 so that the front side drain pan 110 extends over the drain channels 111. In this configuration as well, the same effects as the configuration in which the drain channels 111 are arranged so as to extend over the back side drain pan 115 are achieved. The front side drain pan 110 does not necessarily have to be provided at a higher position than the back side drain pan 115, and the drain water collected in both drain pans can be drained from the drain hose connected to the back side drain pan 115 even when the front side drain pan 110 and the back side drain pan 115 are provided at the same level.

(Nozzle)

The indoor unit 100 according to Embodiment 1 is configured in such a manner that an opening length d1 of a nozzle 6 on the suction side (a throttle length d1 between the drain pans defined by a portion between the front side drain pan 110 and the back side drain pan 115) is defined to be larger than an opening length d2 (the length of the blow-out port 3) of the nozzle 6 on the blow-out side. In other words, the nozzle 6 of the indoor unit 100 has opening lengths which satisfy d1>d2.

The reason why the nozzle 6 is configured to have opening lengths of d1>d2 is as follows. Since the value d2 affects the distribution distance of the airflow, which is one of basic functions of the indoor unit, the opening length d2 of the indoor unit 100 according to Embodiment 1 is assumed to be a comparable length with the blow-out port of the conventional indoor unit in the description given below.

By setting the dimensions of the nozzle 6 in the vertical cross section to be d1>d2, the air path is widened, and an angle A of the heat exchanger 50 arranged on the upstream side (the angle formed between the front side heat exchanger 51 an the back side heat exchanger 55 on the downstream side of the heat exchanger 50) can be widened. Therefore, the wind velocity distribution generated in the heat exchanger 50 is reduced, and the air path of the downstream side of the heat exchanger 50 can be widened, whereby reduction of pressure loss in the entire indoor unit 100 can be achieved. In addition, the deviation of the wind velocity distribution generated in the vicinity of the inlet portion of the nozzle 6 can be unified and guided to the blow-out port by the effect of flow contraction.

For example, when d1=d2, the deviation of the wind velocity distribution generated in the vicinity of the inlet portion of the nozzle 6 (for example, a flow deviated toward the back side) is reflected directly in the deviation of the wind velocity distribution at the blow-out port 3. In other words, when d1=d2, air is blown out from the blow-out port 3 still having the deviation in the wind velocity distribution. When d1<d2 is satisfied, for example, the contraction flow loss is increased when airflows passed through the front side heat exchanger 51 and the back side heat exchanger 55 merge in the vicinity of the inlet portion of the nozzle 6. Therefore, when d1<d2 is satisfied, a loss corresponding to the contraction flow loss is generated unless otherwise a diffusion effect at the blow-out port 3 cannot be obtained.

(ANC)

In the indoor unit 100 according to Embodiment 1, an active silencing mechanism is provided as shown in FIG. 1.

More specifically, the silencing mechanism of the indoor unit 100 according to Embodiment 1 includes a noise detection microphone 161, a control speaker 181, a silencing effect detection microphone 191, and a signal processing device 201. The noise detection microphone 161 is a noise detection device configured to detect an operation sound (noise) of the indoor unit 100 including a blast sound of the fan 20. The noise detection microphone 161 is arranged between the fan 20 and the heat exchanger 50. In Embodiment 1, the noise detection microphone 161 is provided on the front surface portion in the casing 1. The control speaker 181 is a control sound output device configured to output a control sound with respect to the noise. The control speaker 181 is arranged below the noise detection microphone 161 and above the heat exchanger 50. In Embodiment 1, the control speaker 181 is provided on the front surface portion in the casing 1 so as to face the center of the air path. The silencing effect detection microphone 191 is a silencing effect detection device configured to detect the silencing effect using the control sound. The silencing effect detection microphone 191, being intended to detect a noise coming from the blow-out port 3, is provided in the vicinity of the blow-out port 3. The silencing effect detection microphone 191 is attached at a position avoiding the airflow so as not to be exposed to the air coming out from the blow-out port 3. The signal processing device 201 is a control sound generating device configured to cause the control speaker 181 to output the control sound on the basis of the results of detection by the noise detection microphone 161 and the silencing effect detection microphone 191. The signal processing device 201 is housed, for example, in the control device 281.

Figure 8:
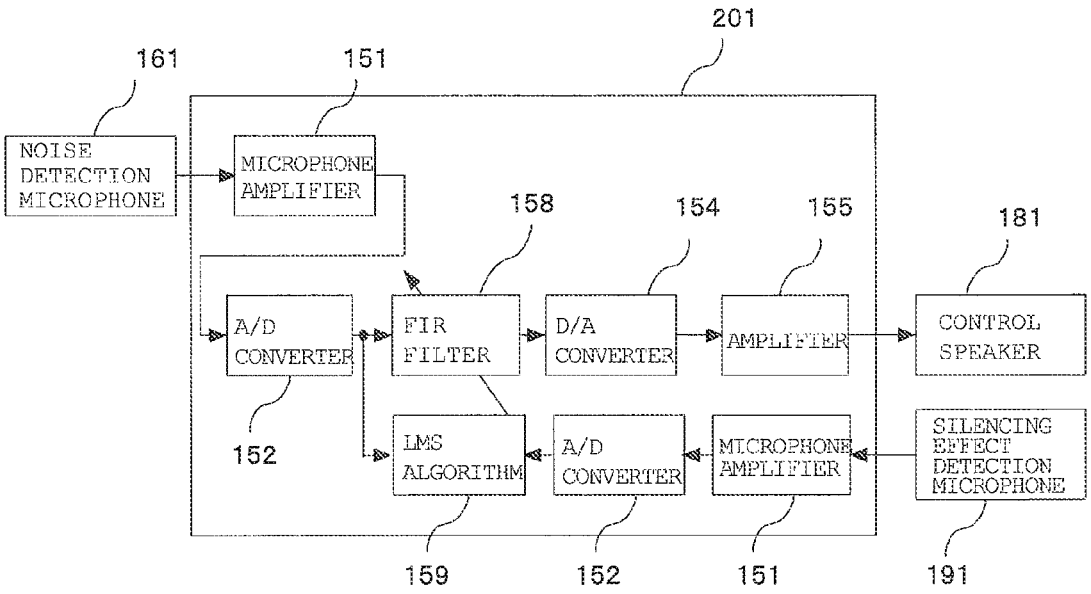
FIG. 8 is a configuration drawing illustrating a signal processing device according to Embodiment 1 of the invention.

FIG. 8 is a configuration drawing illustrating a signal processing device according to Embodiment 1 of the invention. Electric signals supplied from the noise detection microphone 161 and the silencing effect detection microphone 191 are amplified by a microphone amplifier 151, and are converted from analogue signals to digital signals by an A/D converter 152. The converted digital signals are input to an FIR filter 158 and an LMS algorithm 159. In the FIR filter 158, a control signal, which is corrected to cause a noise with the same amplitude as and an opposite phase from the detected noise by the noise detection microphone 161 when the noise reaches a position where the silencing effect detection microphone 191 is installed, and is converted from a digital signal to an analogue signal by an D/A converter 154 then is amplified by an amplifier 155, and then is emitted as the control sound from the control speaker 181.

Figure 7:
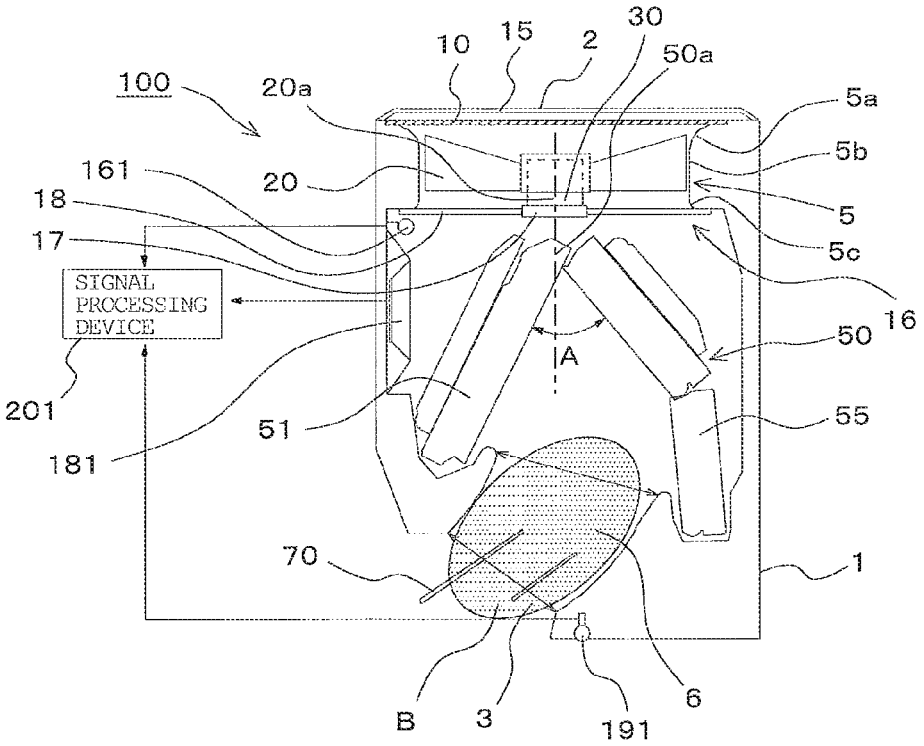
FIG. 7 is a vertical cross-sectional view illustrating a dew condensation generating position of the indoor unit according to Embodiment 1 of the invention.

In a case where the air-conditioning apparatus is in cooling operation, for example, as shown in FIG. 7, the temperature in an area B between the heat exchanger 50 and the blow-out port 3 is lowered due to cool air, thereby causing dew condensation to appear as water droplets from water vapor in the air. Therefore, in the indoor unit 100, a water trap or the like (not shown) is attached in the vicinity of the blow-out port 3 for preventing the water droplets from coming out from the blow-out port 3. The area where the noise detection microphone 161 and the control speaker 181 are arranged, which is on the upstream side of the heat exchanger 50 is not subjected to dew condensation, because it is located on the upstream side of the area to be cooled by cool air.

Subsequently, a method of restraining an operating sound of the indoor unit 100 will be described. The operating sound (noise) including the blast sound of the fan 20 in the indoor unit 100 that is detected by the noise detection microphone 161 attached between the fan 20 and the heat exchanger 50 is converted into a digital signal via the microphone amplifier 151 and the A/D converter 152, and is supplied to the FIR filter 158 and the LMS algorithm 159.

A tap coefficient of the FIR filter 158 is updated sequentially by the LMS algorithm 159. The tap coefficient is updated by the LMS algorithm 159 according to an expression 1 ($h(n+1)=h(n)+2\mu e(n)\times(n)$), and is updated to an optimal tap coefficient so as to cause an error signal e to approach zero.

In the expression shown above, h is a tap coefficient of the filter, e is the error signal, x is a filter input signal, and $\mu$ is a step size parameter, and the step size parameter $\mu$ is used for controlling the update amount of the filter coefficient at every sampling.

In this manner, the digital signal passed through the FIR filter 158 whose tap coefficient is updated by the LMS algorithm 159 is converted into an analogue signal by the D/A converter 154, is amplified by the amplifier 155, and is released into the air path in the indoor unit 100 as the control sound from the control speaker 181 attached between the fan 20 and the heat exchanger 50.

And the silencing effect detection microphone 191, attached to a lower end of the indoor unit 100 on the outer wall of the blow-out port 3 so as to avoid wind blown out from the blow-out port 3, detects a sound which has been propagated from the fan 20 to the air path coming out from the blow-out port, the sound after having been interfered by the control sound released from the control speaker 181.

Since the sound detected by the silencing effect detection microphone 191 is input to the error signal of the LMS algorithm 159 described above, the tap coefficient of the FIR filter 158 is updated so as to cause the sound after the interference to approach zero. Consequently, the noise in the vicinity of the blow-out port 3 can be restrained by the control sound having passed through the FIR filter 158.

In this manner, in the indoor unit 100 to which an active silencing method is applied, the noise detection microphone 161 and the control speaker 181 are arranged between the fan 20 and the heat exchanger 50, and the silencing effect detection microphone 191 is attached to a position avoiding the airflow from the blow-out port 3. Therefore, since it is not necessary to attach members required for active silencing to area B which is subjected to dew condensation, water droplets dropping on the control speaker 181, the noise detection microphone 161, and the silencing effect detection microphone 191 is prevented, and hence deterioration of silencing capabilities or defects of the speaker or the microphone can be prevented.

Figure 9:
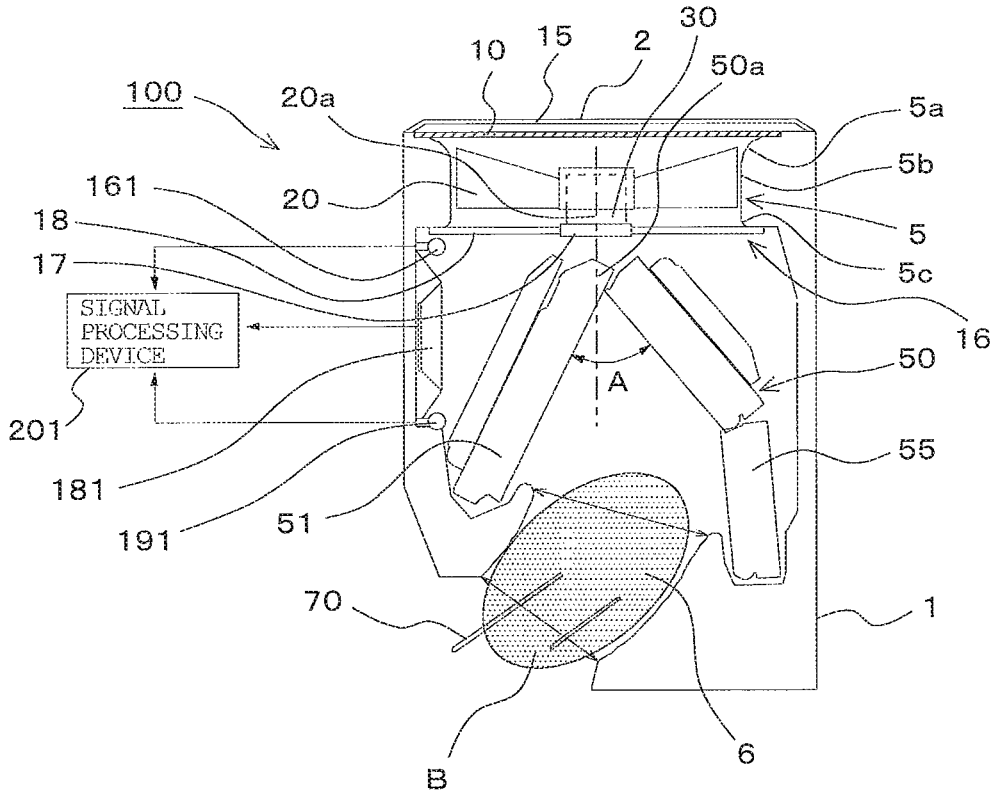
FIG. 9 is a vertical cross-sectional view illustrating another example of the indoor unit of the air-conditioning apparatus according to Embodiment 1 of the invention.

The positions where the noise detection microphone 161, the control speaker 181, and the silencing effect detection microphone 191 are attached shown in Embodiment 1 are only examples. For example, as shown in FIG. 9, the silencing effect detection microphone 191 may be arranged between the fan 20 and the heat exchanger 50 together with the noise detection microphone 161 and the control speaker 181. Although the microphone is exemplified as detecting means for detecting the noise or the silencing effect after having cancelled the noise using the control sound, it may be an acceleration sensor or the like for sensing vibrations of the casing. Alternatively, it is also possible to understand the sound as turbulence of air current, and detect the noise or the silencing effect after having cancelled the noise by the control sound as turbulence of the air current. In other words, a flow velocity sensor which detects the air current or a hot-wire probe may be used as the detecting means for detecting the noise or the silencing effect after having cancelled the noise using the control sound. It is also possible to detect the air current by increasing a gain of the microphone.

Although the FIR filter 158 and the LMS algorithm 159 are employed in the signal processing device 201 in Embodiment 1, any adaptive signal processing circuit may be employed as long as it causes the sound detected by the silencing effect detection microphone 191 to approach zero, and also may be one in which a filtered-X algorithm generally used in the active silencing method is applicable. In addition, the signal processing device 201 may be configured to generate the control signal using a fixed tap coefficient instead of employing adaptive signal processing. And further, the signal processing device 201 may be an analogue signal processing circuit instead of the digital signal processing circuit.

In addition, in Embodiment 1, the heat exchanger 50 disposed to cool air which forms due condensation has been described, but the invention can be applied also to a case where the heat exchanger 50 of a level which does not cause dew condensation is arranged, and has effects to prevent deterioration of performances of the noise detection microphone 161, the control speaker 181, the silencing effect detection microphone 191, and the like without considering the presence or absence of occurrence of due condensation due to the heat exchanger 50.

Embodiment 2

(Drain Pan)

The drain pans to be provided in the indoor unit 100 are not limited to the configuration shown in Embodiment 1, but may be configured as described below, for example. In Embodiment 2, the same numbers as in Embodiment 1 reference the same functions and configurations in the description.

Figure 10:
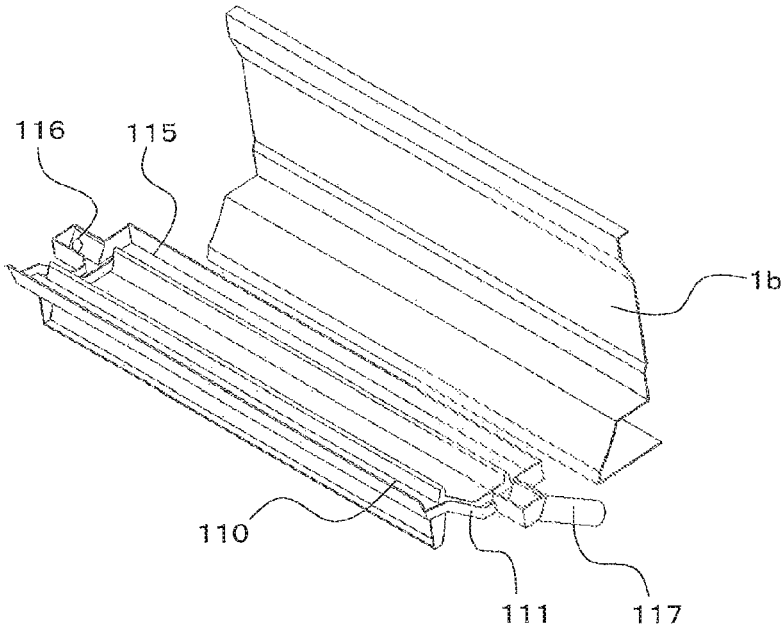
FIG. 10 is a perspective view illustrating an example of the drain pan according to Embodiment 2 of the invention.
Figure 11:
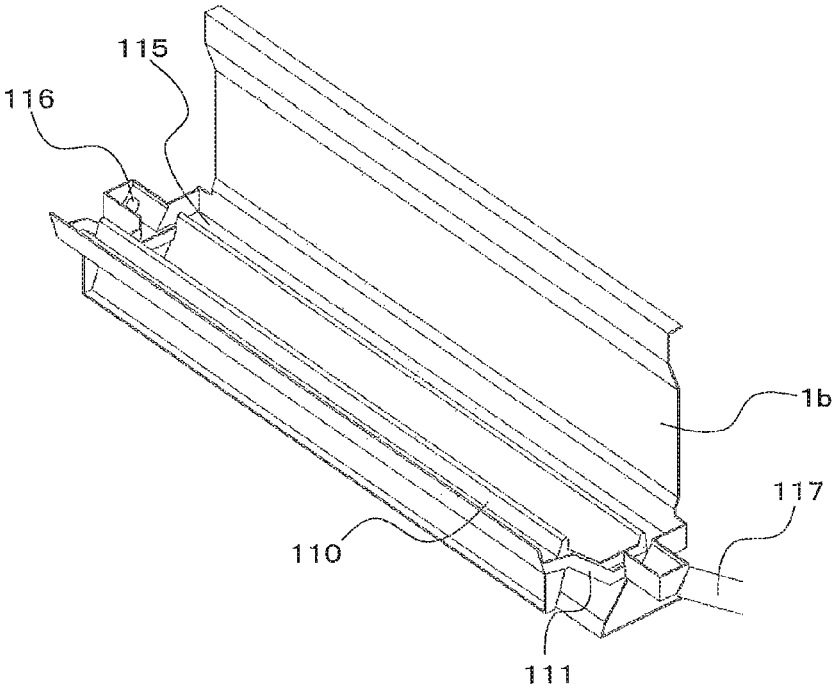
FIG. 11 is a perspective view illustrating an example of the drain pan according to Embodiment 2 of the invention.

FIG. 10 is a perspective view illustrating an example of the drain pan according to Embodiment 2 of the invention. FIG. 11 is a perspective view illustrating another example of the drain pan according to Embodiment 2 of the invention.

As described above, in the indoor unit 100 according to the invention, the fan 20 is arranged on the upstream side of the heat exchanger 50. Therefore, maintenance or the like of the fan 20 (replacement or cleaning or the like of the fan 20) can be performed without attaching and detaching the front side drain pan 110. Therefore, maintainability is improved by merely arranging the fan 20 on the upstream side of the heat exchanger 50, when compared with the conventional indoor unit in which the fan is arranged on the downstream side of the heat exchanger. Therefore, in order to improve the assemblability or the like of the indoor unit 100, the drain pans as shown in FIG. 10 and FIG. 11 may also be applied.

For example, in the drain pan shown in FIG. 10, by connecting the back side end portion of the drain channel 111 and the back side drain pan 115, the front side drain pan 110, the drain channel 111, and the back side drain pan 115 are integrally formed. In this configuration, the indoor unit 100 can be assembled without regard to the level difference of the front side drain pan 110 and the back side drain pan 115. Therefore, the number of steps for assembling the indoor unit 100 can be reduced, and hence the cost of the indoor unit 100 can be reduced.

Also, for example, the drain pan shown in FIG. 11 is formed by further integrating the drain pan shown in FIG. 10 and the back side portion 1*b* of the casing 1. In this configuration as well, the indoor unit 100 can be assembled without regard to the level difference of the front side drain pan 110 and the back side drain pan 115, the number of steps for assembling the indoor unit 100 can be reduced, and the cost of the indoor unit 100 can be reduced. In addition, the cost of molding the drain pan can also be reduced, so that the cost of the indoor unit 100 can further be reduced.

Embodiment 3

In Embodiment 1 and Embodiment 2, the drain pans to be provided in the indoor unit 100 having the heat exchanger 50 of the substantially inverted V-shape in right vertical cross section has been described. The invention is not limited thereto, and the same drain pans as the drain pans described in Embodiment 1 and Embodiment 2 can be provided in the indoor unit 100 having the heat exchangers 50 in various shapes. An example will be described below. In Embodiment 3, items not specifically described are the same as those in Embodiment 1 and Embodiment 2, and the same numbers reference the same functions and configurations in the description.

For example, the invention is not limited to the heat exchanger 50 of the substantially inverted V-shape in right vertical cross section, and the same drain pans as the drain pans described in Embodiment 1 and Embodiment 2 can be provided as long as the indoor unit 100 includes the heat exchanger 50 having two lower end portions (for example, the heat exchangers of a substantially N-shape, a substantially W-shape, or a substantially inverted N-shape in right vertical cross section).

Figure 12:
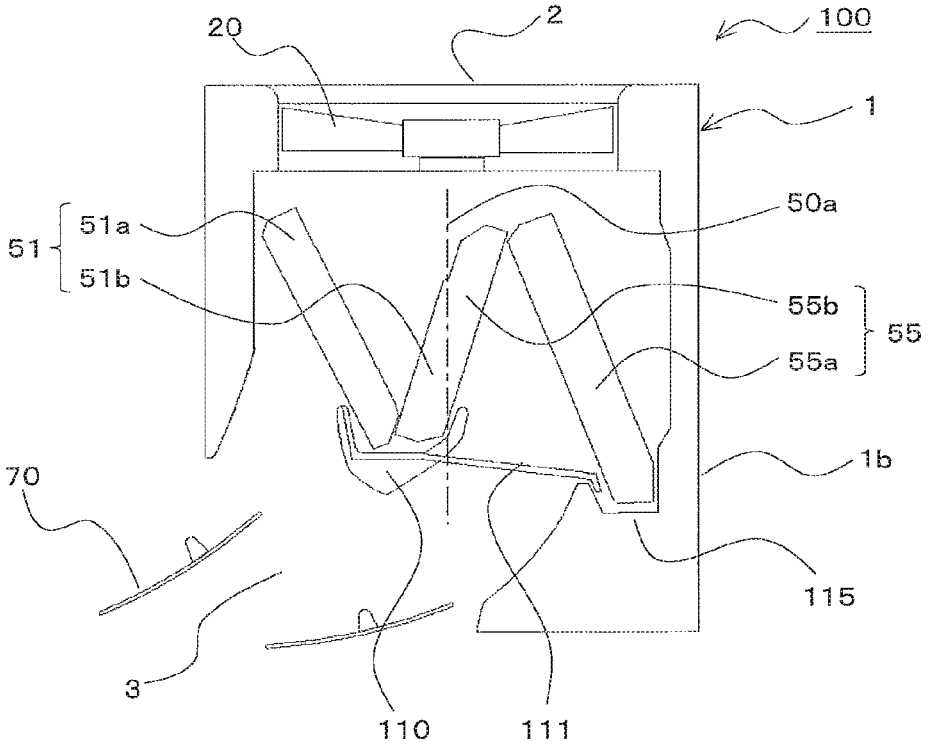
FIG. 12 is a vertical cross-sectional view illustrating an example of the indoor unit according to Embodiment 3 of the invention.

FIG. 12 is a vertical cross-sectional view illustrating an example of the indoor unit according to Embodiment 3 in the invention. FIG. 12 shows the indoor unit 100 having the heat exchanger 50 of the substantially inverted N-shape in right vertical cross section.

As shown in FIG. 12, the heat exchanger 50 of the substantially inverted N-shape in right vertical cross section includes the two lower end portions in right vertical cross section. More specifically, a connecting portion (inflected portion)

between a heat exchanger 51*a* and a heat exchanger 51*b* which constitutes the front side heat exchanger 51 corresponds to the lower end portion, and the back side end portion of a heat exchanger 55*a* which constitutes the back side heat exchanger 55 corresponds to the lower end portion.

In the indoor unit 100 as described above, the front side drain pan 110 shown in Embodiment 1 and Embodiment 2 may be provided below the connecting portion (inflected portion) between the heat exchanger 51*a* and the heat exchanger 51*b* which constitute the front side heat exchanger 51. Also, the back side drain pan 115 shown in Embodiment 1 and Embodiment 2 may be provided below the back side end portion of the heat exchanger 55*a*, which constitutes the back side heat exchanger 55.

By providing the back side drain pan 115 and the front side drain pan 110 in this manner, the drain water collected by both of the drain pans can be gathered in the back side drain pan 115 (the drain pan arranged on the backmost side of the casing 1) in the same manner as in Embodiment 1. Therefore, by providing the connecting port 116 of the drain hose 117 in the back side drain pan 115, the drain water collected in the front side drain pan 110 and the back side drain pan 115 can be drained to the outside of the casing 1. Therefore, it is not necessary to detach and attach the drain pan having the drain hose 117 connected thereto, for example, when performing maintenance (cleaning of the heat exchangers 50 and the like) of the indoor unit 100 after opening the front surface portion or the like of the casing 1, which improves workability during maintenance and the like.

Also, if the indoor unit 100 is provided with the heat exchanger 50 having three or more lower end portions (for example, the heat exchanger of a substantially M-shape in right vertical cross section), the drain pan may be provided, for example, as follows.

Figure 13:
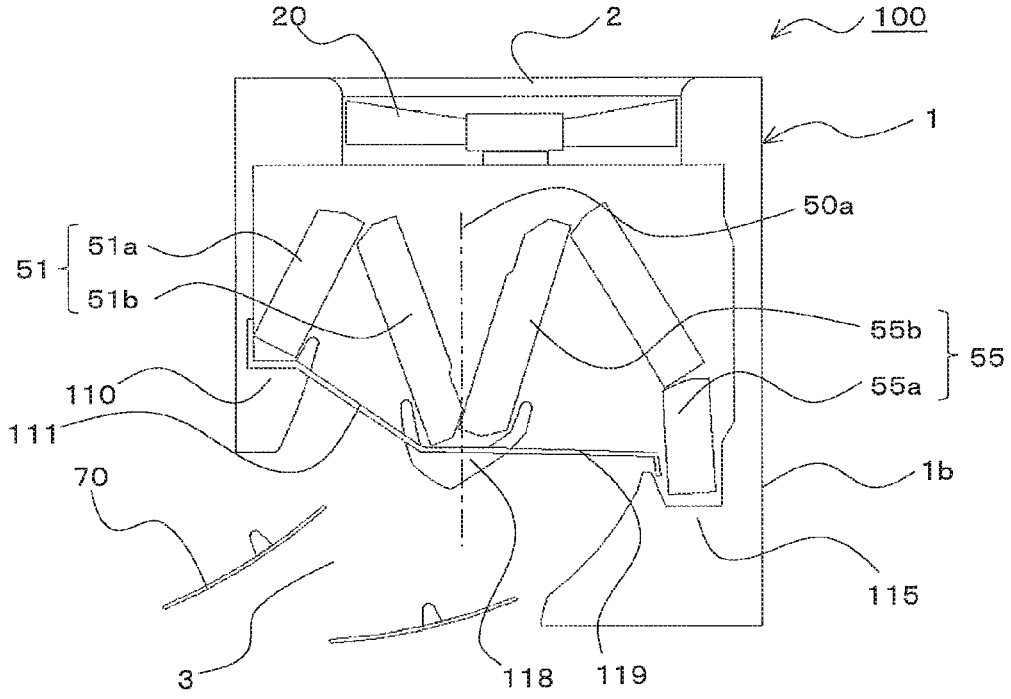
FIG. 13 is a vertical cross-sectional view illustrating another example of the indoor unit according to Embodiment 3 of the invention.
Figure 14:
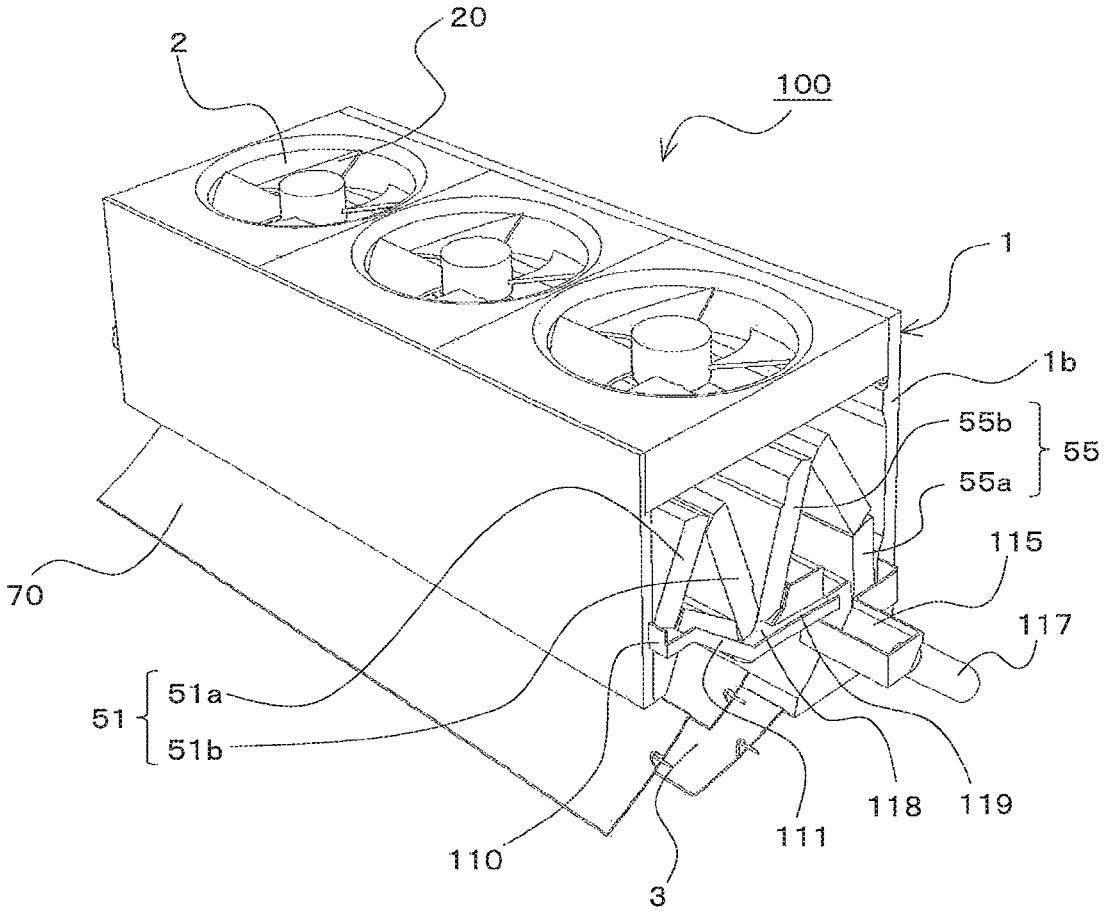
FIG. 14 is a perspective view of another example of the indoor unit according to Embodiment 3 of the invention when viewed from the front right side.
Figure 15:
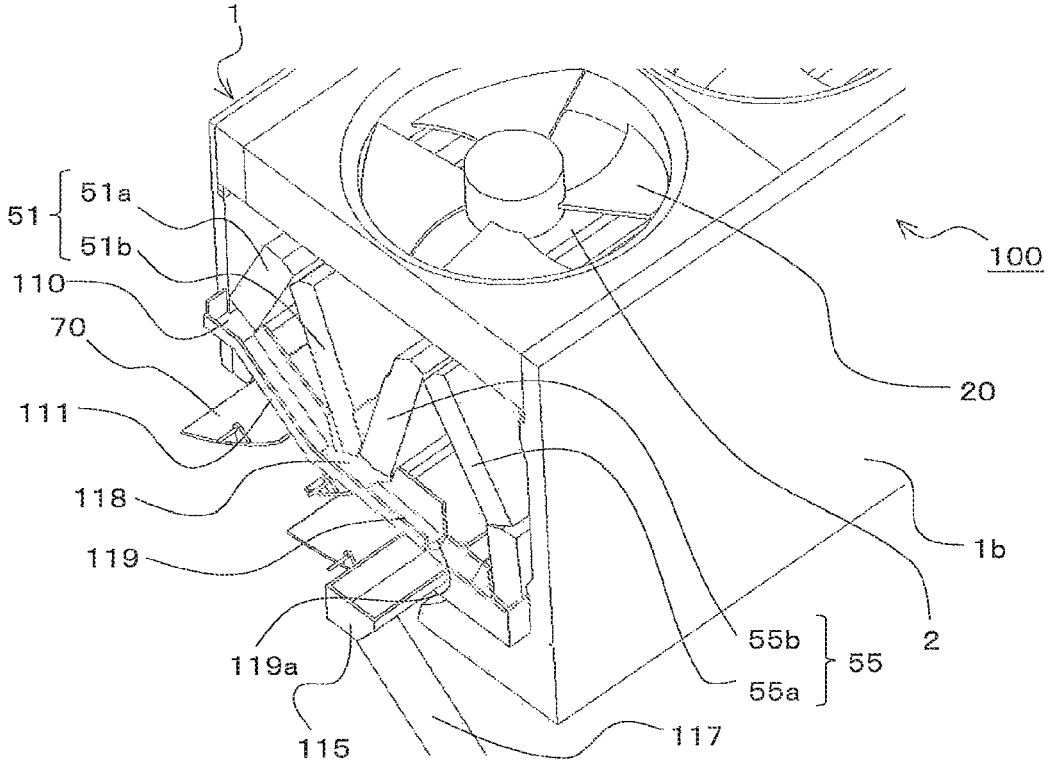
FIG. 15 is a perspective view of another example of the indoor unit according to Embodiment 3 of the invention when viewed from the back right side.
Figure 16:
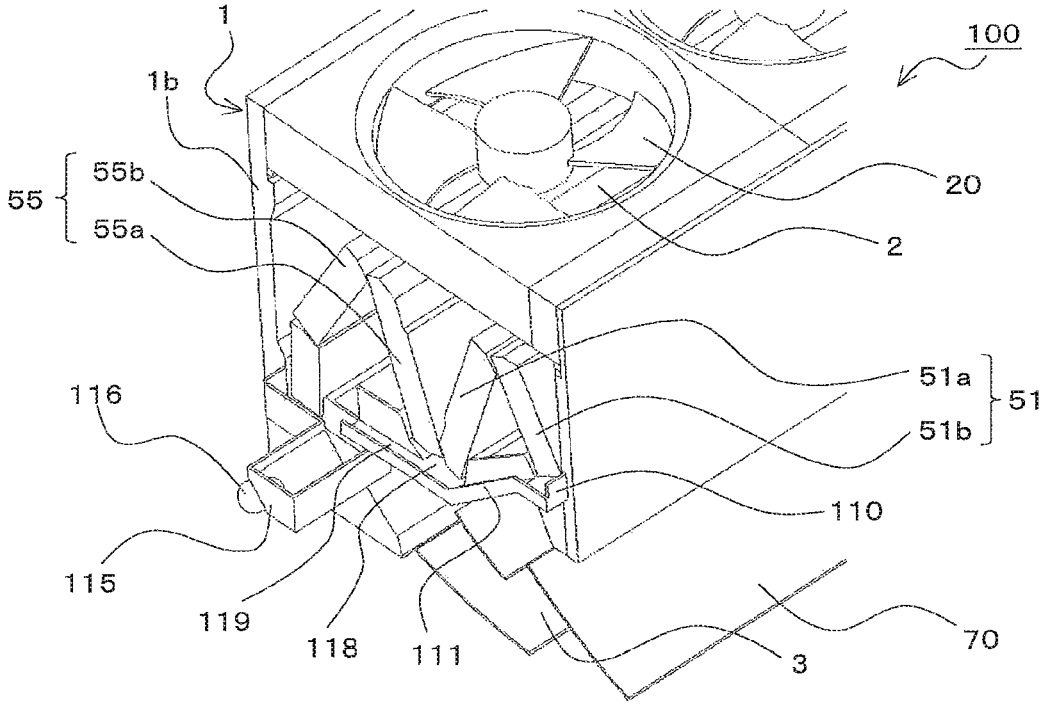
FIG. 16 is a perspective view of another example of the indoor unit according to Embodiment 3 of the invention when viewed from the front left side.
Figure 17:
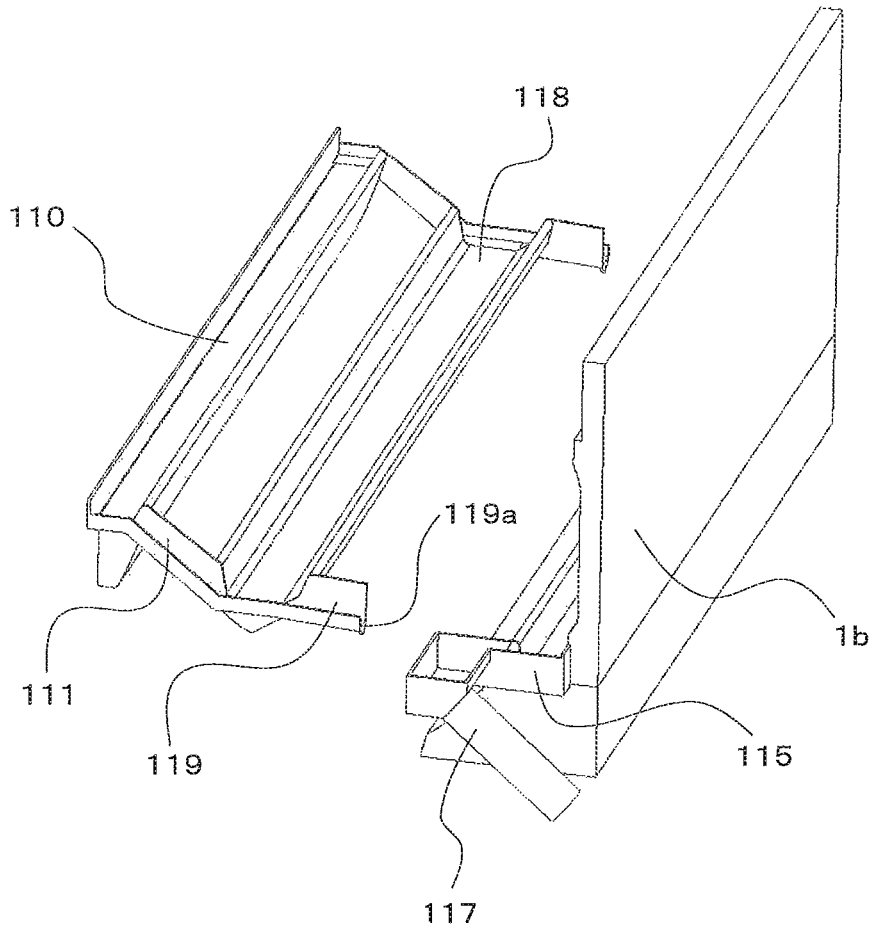
FIG. 17 is a perspective view illustrating a drain pan provided in another example of the indoor unit according to Embodiment 3 of the invention.

FIG. 13 is a vertical cross-sectional view illustrating another example of the indoor unit according to Embodiment 3 of the invention. FIG. 14 is a perspective view of the same indoor unit when viewed from the front right side. FIG. 15 is a perspective view of the same indoor unit when viewed from the back right side. FIG. 16 is a perspective view of the same indoor unit when viewed from the front left side. FIG. 17 is a perspective view illustrating the drain pan provided in the same indoor unit. In order to facilitate understanding of the shape of the drain pan, the right side of the indoor unit 100 is shown in cross section in FIG. 14 and FIG. 15, and the left side of the indoor unit 100 is shown in cross section in FIG. 16.

The heat exchanger 50 of the substantially M-shape in right vertical cross section forms a three lower end portions in right vertical cross section. More specifically, the front side end portion of the heat exchanger 51*a* which constitutes the front side heat exchanger 51 corresponds to the lower end portion, the connecting portion (inflected portion) between the heat exchanger 51*b* which constitutes the front side heat exchanger 51 and a heat exchanger 55*b* which constitutes the back side heat exchanger 55 corresponds to the lower end portion, and back side end portion of the heat exchanger 55*a* which constitutes the back side heat exchanger 55 corresponds to the lower end portion.

In the indoor unit 100 as described above, an intermediate drain pan 118 may be provided at the lower portion formed between the lower end portion on the front side and the lower end portion of the back side (at the connecting portion between the heat exchanger 51*b* which constitutes the front side heat exchanger 51 and the heat exchanger 55*b* which constitutes the back side heat exchanger 55). More specifically, provided below the front side end portion of the heat exchanger 51*a* which constitutes the front side heat exchanger 51 is the front side drain pan 110. Provided below the connecting portion between the heat exchanger 51*b* which constitutes the front side heat exchanger 51 and the heat exchanger 55*b* which constitutes the back side heat exchanger 55 is the intermediate drain pan 118. Provided below the back side end portion of the heat exchanger 55*a* which constitutes the heat exchanger 55 is the back side drain pan 115. The back side drain pan 115 and the back side portion 1*b* of the casing 1 are integrally formed. In the back side drain pan 115, the connecting ports 116 to which the drain hoses 117 are connected are provided on both the left side end portion and the right side end portion.

The front side drain pan 110 is arranged at a position higher than the intermediate drain pan 118. The intermediate drain pan 118 is arranged at a position higher than the back side drain pan 115. The drain channels 111 which correspond to drain flow channels are provided between the front side drain pan 110 and the back side drain pan 115 on both the left side end portion and the right side end portion. Provided between the intermediate drain pan 118 and the back side drain pan 115 on both the left side end portion and the right side end portion are drain channels 119 which correspond to drain flow channels. The drain channel 111 is connected at an end portion on the front side to the front side drain pan 110, and is connected at an end portion on the back side to the intermediate drain pan 118. The drain channel 111 is provided so as to be inclined downward from the front side drain pan 110 toward the intermediate drain pan 118. The drain channel 119 is connected at an end portion on the front side to the intermediate drain pan 118, and is provided so as to incline downward from the intermediate drain pan 118 toward the back side drain pan 115. Also, a tongue portion 119*a* is formed at an end portion on the back side of the drain channel 119. The end portion on the back side of the drain channel 119 is arranged so as to extend over an upper surface of the back side drain pan 115.

By providing drain pans (the front side drain pan 110, the intermediate drain pan 118, and the back side drain pan 115) below the heat exchanger 50 in this manner, dew on the heat exchanger 50 drops into the respective drain pans from the respective lower end portions of the heat exchanger 50, and is collected in the respective drain pans. The drain water collected in the front side drain pan 110 and the intermediate drain pan 118 is gathered in the back side drain pan 115 via the drain channel 111 and the drain channel 119, The drain water gathered in the back side drain pan 115 passes through the drain hose 117, and is drained to the outside of the casing 1 (the indoor unit 100).

By providing the respective drain pans (the front side drain pan 110, the intermediate drain pan 118, and the back side drain pan 115) as described above, the drain water collected in the respective drain pans can be gathered in the back side drain pan 115 (the drain pan arranged on the backmost side of the casing 1). Therefore, by providing the connecting port 116 of the drain hose 117 in the back side drain pan 115, the drain water collected in the front side drain pan 110 and the back side drain pan 115 can be drained to the outside of the casing 1. Therefore, it is not necessary to detach and attach the drain pan having the drain hose 117 connected thereto, for example, when performing maintenance (cleaning of the heat exchangers 50 and the like) of the indoor unit 100 after opening the front surface portion or the like of the casing 1, which improves workability during maintenance and the like.

The drain pans shown in FIGS. 13 to 17 are formed by integrating the front side drain pan 110, the drain channel 111, the intermediate drain pan 118, and the drain channel 119. In other words, the drain pans shown in FIGS. 13 to 17 are segmentalized between the drain channel 119 and the back side drain pan 115. However, the segmenting position (the position not to be connected) is arbitrary. The segmenting position (the position not to be connected) may be determined considering maintainability, assemblability, and so on. Also, the front side drain pan 110 does not necessarily have to be at a level higher than the intermediate drain pan 118, and the intermediate drain pan 118 does not necessarily have to be at a level higher than the back side drain pan 115. Even when the front side drain pan 110 and the intermediate drain pan 118 are positioned in the same level, the drain water collected in the both drain pans can be drained from the drain hose connected to the back side drain pan 115. In the same manner, even when the intermediate drain pan 118 and the back side drain pan 115 are positioned in the same level, the drain water collected in the both drain pans can be drained from the drain hose connected to the back side drain pan 115.

REFERENCE SIGNS LIST casing, 1*b* back side portion, 2 suction port, 3 blow-out port, 5 bell mouth, 5*a* upper portion, 5*b* center portion, 5*c* lower portion, 6 nozzle, filter, 15 finger guard, 16 motor stay, 17 fixed member, 18 supporting member, 20 fan, 20*a* axis of rotation, 21 boss, 30 fan motor, 50 heat exchanger, 50*a* line of symmetry, 51 front side heat exchanger, 51*a* heat exchanger, 51*b* heat exchanger, 55 back side heat exchanger, 55*a* heat exchanger, 55*b* heat exchanger, 70 vertical wind direction control vane, 80 horizontal wind direction control vane, 90 partitioning panel, 100 indoor unit, 110 front side drain pan, 111 drain channel, 111*a* tongue portion, 115 back side drain pan, 116 connecting port, 117 drain hose, 118 intermediate drain pan, 119 drain channel, 19*a* tongue portion, 151 microphone amplifier, 152 A/D converter, 154 DIA converter, 155 amplifier, 158 FIR filter, 159 LMS algorithm, 161 noise detection microphone, 181 control speaker, 191 silencing effect detection microphone, 201 signal processing device

What is claimed is:

1. An indoor unit of an air-conditioning apparatus comprising:

a casing having a suction port formed on an upper portion and a blow-out port formed on a lower side of a front surface portion, the front surface portion being openable to access an interior of the casing;

a heat exchanger provided in the casing, and formed with a plurality of lower end portions in a vertical cross section from the front side to the back side of the casing;

an axial-flow or mixed-flow fan provided on a lower side of the suction port and an upper side of the heat exchanger in the casing;

a plurality of drain pans provided under the lower end portions of the heat exchanger respectively and configured to collect drain water occurring on the heat exchanger;

a drain channel provided between the drain pans adjacent to each other to form a drain flow channel; and connecting ports each allowing connection of a drain hose, provided on both a left end portion and a right end portion of a drain pan arranged on the backmost side of the casing among the plurality of the drain pans, for draining the drain water collected by the plurality of drain pans to the outside of the casing, wherein the drain pans adjacent to each other among the plurality of drain pans are arranged so that a drain pan provided on the front side of the casing is arranged at a level higher than a drain pan provided on the back side of the casing, wherein the drain pan arranged on the backmost side of the casing has a segment at each of the left and right end portions which extend from a portion of the drain pan underneath the lower end of the heat exchanger toward the front of the casing underneath a portion of the drain channel, and then extend toward the left and right respectively, and wherein the drain channel is provided so as to incline downward from a front side toward a back side of the casing, whereby drain water that flows through the drain channel is drained by passing through the connecting ports provided on the drain pan arranged on the backmost side of the casing.

2. The indoor unit of the air-conditioning apparatus of claim 1, wherein the drain channels are provided on both left end portions and right end portions of the drain pans.

3. An indoor unit of an air-conditioning apparatus comprising:

a casing having a suction port formed on an upper portion and a blow-out port formed on a lower side of a front surface portion, the front surface portion being openable to access an interior of the casing;

a heat exchanger provided in the casing and formed with a plurality of lower end portions in a vertical cross section from the front side to the back side of the casing;

an axial-flow or mixed-flow fan provided on a lower side of the suction port and an upper side of the heat exchanger in the casing;

a plurality of drain pans provided under the lower end portions of the heat exchanger respectively and configured to collect drain water occurring on the heat exchanger;

a drain channel provided between the drain pans adjacent to each other to form a drain flow channel; and a connecting port allowing connection of a drain hose, provided on a drain pan arranged on the backmost side of the casing among the plurality of the drain pans, for draining the drain water collected by the plurality of drain pans to the outside of the casing, wherein the drain pans adjacent to each other among the plurality of drain pans are arranged so that a drain pan provided on the front side of the casing is arranged at a level higher than a drain pan provided on the back side of the casing, wherein the drain channel is connected at only one end portions to the drain pan provided on the corresponding end portion, wherein an end portion of the drain channel on the side which is not connected to the drain pan and the drain pan provided on the side of the corresponding end portion are arranged so that either extends over the other, wherein the drain pan arranged on the backmost side of the casing has a segment at each of the left and right end portions which extend from a portion of the drain pan underneath the lower end of the heat exchanger toward the front of the casing underneath a portion of the drain channel, and then extend toward the left and right respectively, and wherein the drain channel is provided so as to incline downward from a front side toward a back side of the casing, whereby drain water that flows through the drain channel is drained by passing through the connecting port provided on the drain pan arranged on the backmost side of the casing.

4. An indoor unit of an air-conditioner apparatus according to claim 1, wherein the drain channel is arranged to extend from the drain pan provided at the front side of the casing to extend over the drain pan provided at a back side of the casing.

5. An air conditioning apparatus according to claim 3, wherein the drain channel is arranged to extend from the drain pan provided at the front side of the casing to extend over the drain pan provided at a back side of the casing.

6. An indoor unit of an air-conditioning apparatus comprising:

a casing having a suction port formed on an upper portion and a blow-out port formed on a lower side of a front surface portion, the front surface portion being openable to access an interior of the casing;

a heat exchanger provided in the casing, and formed with three or more lower end portions in a vertical cross section from the front side to the back side of the casing;

an axial-flow or mixed-flow fan provided on a lower side of the suction port and an upper side of the heat exchanger in the casing;

a plurality of drain pans provided under the lower end portions of the heat exchanger respectively and configured to collect drain water occurring on the heat exchanger;

a drain channel provided between the drain pans adjacent to each other to form a drain flow channel; and a connecting port allowing connection of a drain hose, provided on a drain pan arranged on the backmost side of the casing among the plurality of the drain pans, for draining the drain water collected by the plurality of drain pans to the outside of the casing, wherein the drain pans adjacent to each other among the plurality of drain pans are arranged so that a drain pan provided on the front side of the casing is arranged at a level higher than a drain pan provided on the back side of the casing, wherein the drain pan arranged on the backmost side of the casing has a segment at each of the left and right end portions which extend from a portion of the drain pan underneath the lower end of the heat exchanger toward the front of the casing underneath a portion of the drain channel, and then extend toward the left and right respectively, and wherein the drain channel is provided so as to incline downward from a front side toward a back side of the casing, whereby drain water that flows through the drain channel is drained by passing through the connecting port provided on the drain pan arranged on the backmost side of the casing.

* * * * *